US010857560B2

(12) United States Patent
Kishimoto et al.

(10) Patent No.: US 10,857,560 B2
(45) Date of Patent: Dec. 8, 2020

(54) ROTARY ATOMIZATION TYPE PAINTING DEVICE AND ATOMIZATION HEAD

(71) Applicant: HONDA MOTOR CO., LTD., Tokyo (JP)

(72) Inventors: Naoki Kishimoto, Tochigi (JP); Masaaki Shoji, Tochigi (JP); Hiroko Koike, Tochigi (JP); Koji Ikeda, Tochigi (JP); Osamu Yashima, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 61 days.

(21) Appl. No.: 15/758,806

(22) PCT Filed: Jul. 20, 2016

(86) PCT No.: PCT/JP2016/071261
§ 371 (c)(1),
(2) Date: Mar. 9, 2018

(87) PCT Pub. No.: WO2017/047223
PCT Pub. Date: Mar. 23, 2017

(65) Prior Publication Data

US 2019/0083997 A1 Mar. 21, 2019

(30) Foreign Application Priority Data

Sep. 17, 2015 (JP) ..... 2015-184533

(51) Int. Cl.
*B05B 15/18* (2018.01)
*B05B 3/10* (2006.01)

(52) U.S. Cl.
CPC ..... *B05B 15/18* (2018.02); *B05B 3/1014* (2013.01); *B05B 3/1064* (2013.01)

(58) Field of Classification Search
CPC ..... B05B 3/10; B05B 3/1007; B05B 3/1021; B05B 3/1028; B05B 3/1057; B05B 3/1014; B05B 3/1064; B05B 15/18
See application file for complete search history.

(56) References Cited

U.S. PATENT DOCUMENTS 5,820,036 A * 10/1998 Saito ..... B05B 3/1064 239/703
8,851,397 B1 * 10/2014 van der Steur ..... B05B 3/1064 239/112

FOREIGN PATENT DOCUMENTS

BE 882449 A 7/1980
CN 102712006 A 10/2012
(Continued)

OTHER PUBLICATIONS

International Search Report, dated Oct. 18, 2016 (Oct. 18, 2016), 2 pages.
Chinese Office Action dated Aug. 9, 2019, 8 pages.

*Primary Examiner* — Jason J Boeckmann
(74) *Attorney, Agent, or Firm* — Rankin, Hill & Clark LLP

(57) ABSTRACT

A rotary atomization type painting device includes an atomization head that supplies paint from a paint supply machine. The atomization head has an outer member that includes a truncated conical body, and an inner member that is disposed inside the outer member. The inner member has an annular protruding part that protrudes toward a large diameter side opening. The paint is lead out from a plurality of lead-out holes of the inner member to a root of the annular protruding part. At a root position in an axial direction, an angle in a lead-out direction of each of the lead-out holes with respect to an axis, and an angle of an inner surface of the annular protruding part with respect to the axis are made equal.

4 Claims, 5 Drawing Sheets

(56) References Cited

FOREIGN PATENT DOCUMENTS

| | | | | | |
|---|---|---|---|---|---|
| JP | 53-147740 | | | 12/1978 | |
| JP | 08084941 | A | * | 4/1996 | ..... B05B 3/1064 |
| JP | 10-216568 | | | 8/1998 | |
| JP | 2003-080123 | | | 3/2003 | |
| JP | 2005-118710 | | | 5/2005 | |
| JP | 2009-297645 | | | 12/2009 | |
| JP | 2012-187527 | | | 10/2012 | |
| JP | 2013-166113 | A | | 8/2013 | |
| JP | 5594735 | | | 8/2014 | |
| JP | 2014-213273 | | | 11/2014 | |

* cited by examiner

ROTARY ATOMIZATION TYPE PAINTING DEVICE AND ATOMIZATION HEAD

TECHNICAL FIELD

The present invention relates to a rotary atomization type painting device, and an atomization head used in the same.

BACKGROUND ART

Conventionally, there is known a rotary atomization type painting device that jets paint in an atomized state from an atomization head toward an object to be coated while the atomization head is rotated (example: Patent Literatures 1, 2).

In a rotary atomization type painting device in each of Patent Literatures 1, 2, an atomization head has an outer member that includes a truncated conical body having open both ends on a large diameter side and a small diameter side, and an inner member that is disposed inside the outer member, and is configured to lead out paint supplied from the small diameter open end of the outer member to the inner member, toward the large diameter open end of the outer member through a plurality of lead-out holes formed in a peripheral part of the inner member, and atomize the paint from the large diameter open end of the outer member. Additionally, a paint supply machine that supplies the paint to the atomization head engages with the small diameter open end of the outer member, and supplies the paint to the inner member while the atomization head is rotated around the axis of the cylindrical body.

Such a painting device is used in, a process for painting a vehicle body of a motor vehicle, for example. In order to enhance the grade of the painting, hard flakes such as metal and a natural stone are sometimes mixed in the paint. When the paint mixed with such hard flakes is supplied to the inside of the atomization head rotating at a high speed to move to the large diameter side along an inner surface of the outer member, the flakes mixed in the paint led out from the lead-out holes of the inner member violently collide with an inner surface of the atomization head. Therefore, the inner surface of the atomization head wears quickly compared to a case of painting by paint mixed with no flakes. Consequently, the life of the atomization head is shortened.

In order to cope with this, in the rotary atomization type painting device in Patent Literature 1, the inner surface of the outer member is coated with a film having wear resistance, so that wear of the inner surface of the atomization head is reduced.

CITATION LIST

Patent Literature

Patent Literature 1: Japanese Patent Laid-Open No. 2003-80123
Patent Literature 2: Japanese Patent No. 5594735

SUMMARY OF INVENTION

Technical Problem

However, in the coping method of Patent Literature 1, a process of forming the film on the inner surface of the atomization head is added, and therefore labor and cost for manufacturing are increased.

An object of the present invention is to enable an extended life of an atomization head by reducing the wear of the atomization head by a method other than formation of a film on the inside of the atomization head, in the above rotary atomization type painting device.

Solution to Problem

A rotary atomization type painting device of the present invention includes:

an atomization head having an outer member that includes a truncated conical body having both open ends on a large diameter side and a small diameter side, an inner member that is disposed inside the outer member, and a plurality of lead-out holes that are formed in a peripheral part of the inner member, the atomization head being configured to lead out paint supplied from the small diameter open end of the outer member to the inner member, toward the large diameter open end of the outer member through the lead-out holes, and atomize the paint from the large diameter open end; and a paint supply machine that engages with the small diameter open end, and supplies the paint to the inner member while rotating the atomization head around an axis of the cylindrical body, wherein the inner member has an annular protruding part that protrudes so as to gradually thin toward the large diameter open end, and is formed such that an outer surface of the inner member is closely adhered to an inner surface of the outer member, and the lead-out holes and the annular protruding part are formed such that an angle in a lead-out direction of each of the lead-out holes with respect to the axis of the cylindrical body, and an angle of an inner surface of the annular protruding part with respect to the axis of the cylindrical body are equal at a position of an end on a side of the large diameter open end of the lead-out hole in an axial direction of the cylindrical body.

According to the rotary atomization type painting device of the present invention, the paint supplied to the inner member of the rotating atomization head is led out from the lead-out holes, and thereafter moves to the inner surface of the outer member while expanding in the annular protruding part in the circumferential direction. Here, the annular protruding part is formed so as to gradually thin toward the large diameter open end of the outer member, and therefore the paint led out from the lead-out holes can smoothly move from the annular protruding part to the inner surface of the outer member. Consequently, impact force of the paint to the inner surface of the outer member is relaxed.

The angle in the lead-out direction of each of the lead-out holes with respect to the axis of the cylindrical body, and the angle of the inner surface of the annular protruding part with respect to the axis of the cylindrical body are set to be equal at the position of the end on the large diameter open end of the lead-out hole in the axial direction of the cylindrical body, and therefore the paint moves from the lead-out holes in substantially straight lines along the inner surface of the annular protruding part, and can move to the inner surface of the outer member without separating from the inner surface while the impact force with the inner surface of the annular protruding part is relaxed.

Thus, in the rotary atomization type painting device, it is possible to suppress wear due to collision of the paint to the inner surface of the outer member of the atomization head to extend the life.

Preferable, in the rotary atomization type painting device of the present invention, at a position of an end on a side of the large diameter open end of the annular protruding part in the axial direction of the cylindrical body, an inclination angle of the inner surface of the annular protruding part with respect to the axis of the cylindrical body is set to at least an inclination angle of the inner surface of the outer member.

With this preferable aspect, the paint diffuses to the large diameter open end without deviating from the inner surface of the outer member when moving from the annular protruding part to the inner surface of the outer member. Consequently, diffusibility of the paint inside the atomization head is improved.

Preferably, in the rotary atomization type painting device of the present invention, the inner member is detachably attached to the outer member.

With this preferable aspect, when wear due to the paint is generated in the inner surface of the annular protruding part and the lead-out holes, it is possible to cope with the wear by replacement of the inner member. Consequently, it is possible to more easily and more economically cope with the wear compared to a case of replacement of the whole atomization head.

Preferably, in the rotary atomization type painting device of the present invention, the outer member preferably has, on an inner surface on a side close to the large diameter open end with respect to the annular protruding part, a first paint diffusion part formed as a convex surface toward the axis of the cylindrical body, and a second paint diffusion part, formed as a concave surface toward the axis of the cylindrical body, extending from the first paint diffusion part to an outer edge of the large diameter open end, and the second paint diffusion part has a plurality of grooves provided on the outer edge.

According to this preferable aspect, the paint that enters the inner surface of the outer member from the inner surface of the annular protruding part moves in the first paint diffusion part. The first paint diffusion part includes the curved surface projecting toward the axis of the cylindrical body, and therefore the paint advancing direction comes close to the direction of centrifugal force. Consequently, the paint satisfactorily diffuses in the first paint diffusion part, while reduction in the advancing speed due to film-thinning is suppressed. The second paint diffusion part includes the curved surface recessed toward the axis of the cylindrical body, and therefore the lengths of the grooves of the second paint diffusion part in the axial direction of the cylindrical body are secured compared with a case where the grooves are formed on a tapered surface, and the paint is suitably formed in liquid thread shapes by the grooves to be discharged from the atomization head.

An atomization head of the present invention including:

an outer member that includes a truncated conical body having both open ends on a large diameter side and a small diameter side;

an inner member that is disposed inside the outer member, and a plurality of lead-out holes that are formed in a peripheral part of the inner member, the atomization head being configured to lead out paint supplied from the small diameter open end of the outer member to the inner member, toward the large diameter open end of the outer member through the lead-out holes, and atomize the paint from the large diameter open end, wherein the inner member has an annular protruding part that protrudes so as to gradually thin toward the large diameter open end, and is formed such that an outer surface of the inner member is closely adhered to an inner surface of the outer member, and the lead-out holes and the annular protruding part are formed such that an angle in a lead-out direction of each of the lead-out holes with respect to the axis of the cylindrical body, and an angle of an inner surface of the annular protruding part with respect to the axis of the cylindrical body are equal at a position of an end on a side of the large diameter open end of the lead-out hole in an axial direction of the cylindrical body.

According to the atomization head of the present invention, the paint supplied to the inner member of the rotating atomization head is led out from the lead-out holes, and moves to the inner surface of the outer member while expanding in the annular protruding part in the circumferential direction. Here, the annular protruding part is formed so as to gradually thin toward the large diameter open end of the outer member, and therefore the paint led out from the lead-out holes can smoothly move from the end of the annular protruding part to the inner surface of the outer member. Consequently, impact force of the paint to the inner surface of the outer member is relaxed.

The angle in the lead-out direction of each of the lead-out holes with respect to the axis of the cylindrical body, and the angle of the inner surface of the annular protruding part with respect to the axis of the cylindrical body are set to be equal at the position of the end on the large diameter open end of the lead-out hole in the axial direction of the cylindrical body, and therefore the paint moves from the lead-out holes in substantially straight lines along the inner surface of the annular protruding part, and can move to the inner surface of the outer member without separating from the inner surface while the impact force with the inner surface of the annular protruding part is relaxed.

It is possible to suppress wear due to collision of the paint to the inner surface of the outer member of the atomization head, and extend the life.

DESCRIPTION OF EMBODIMENTS

Figure 1A:
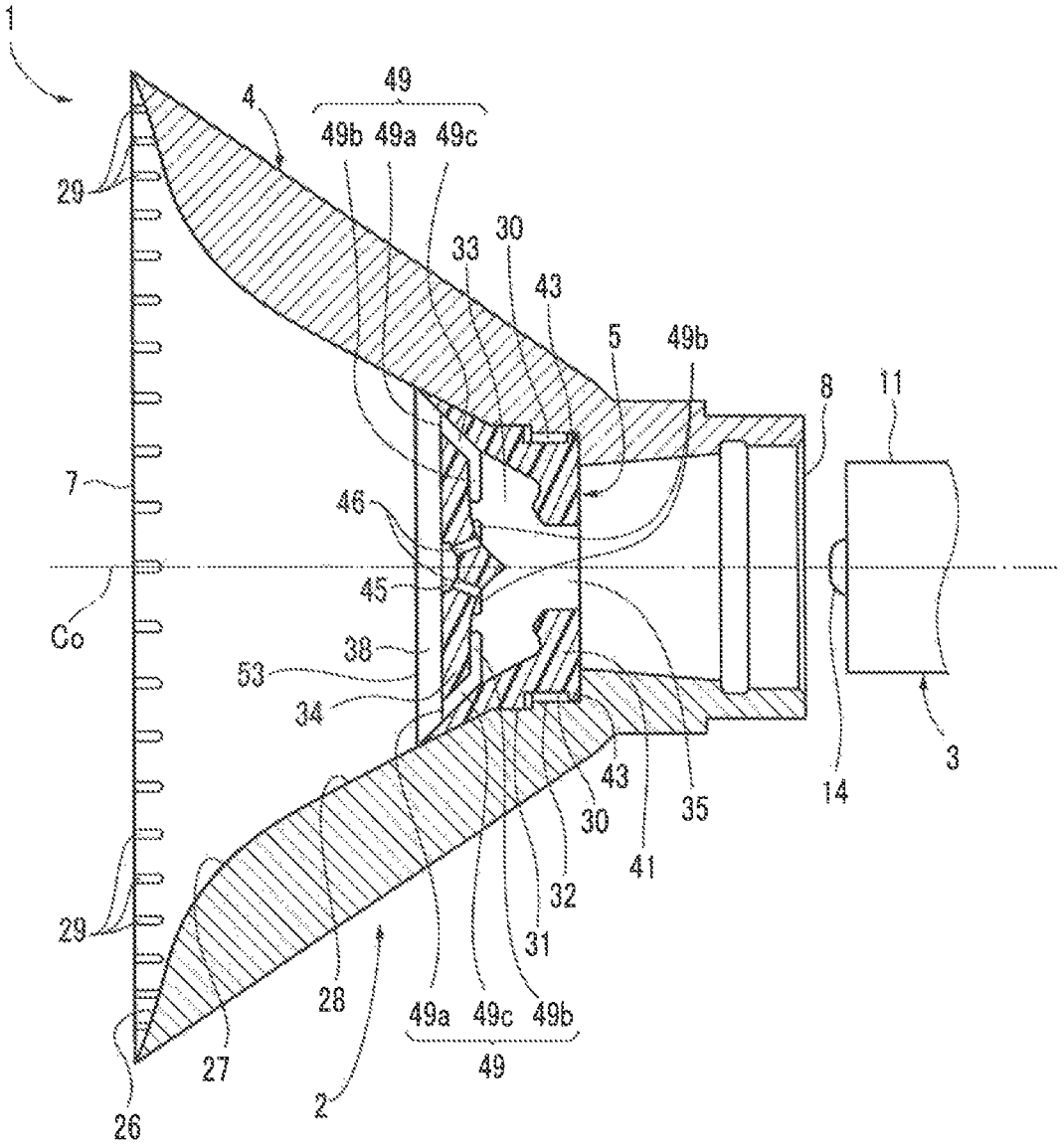
FIG. 1A, FIG. 1B, and FIG. 1C are a sectional view of a first embodiment of a rotary atomization type painting device of the present invention, an enlarged perspective view of a lead-out hole, and a diagram illustrating screwed engagement in place of connection of an L-shaped groove and a protrusion of the first embodiment, respectively.
Figure 3:
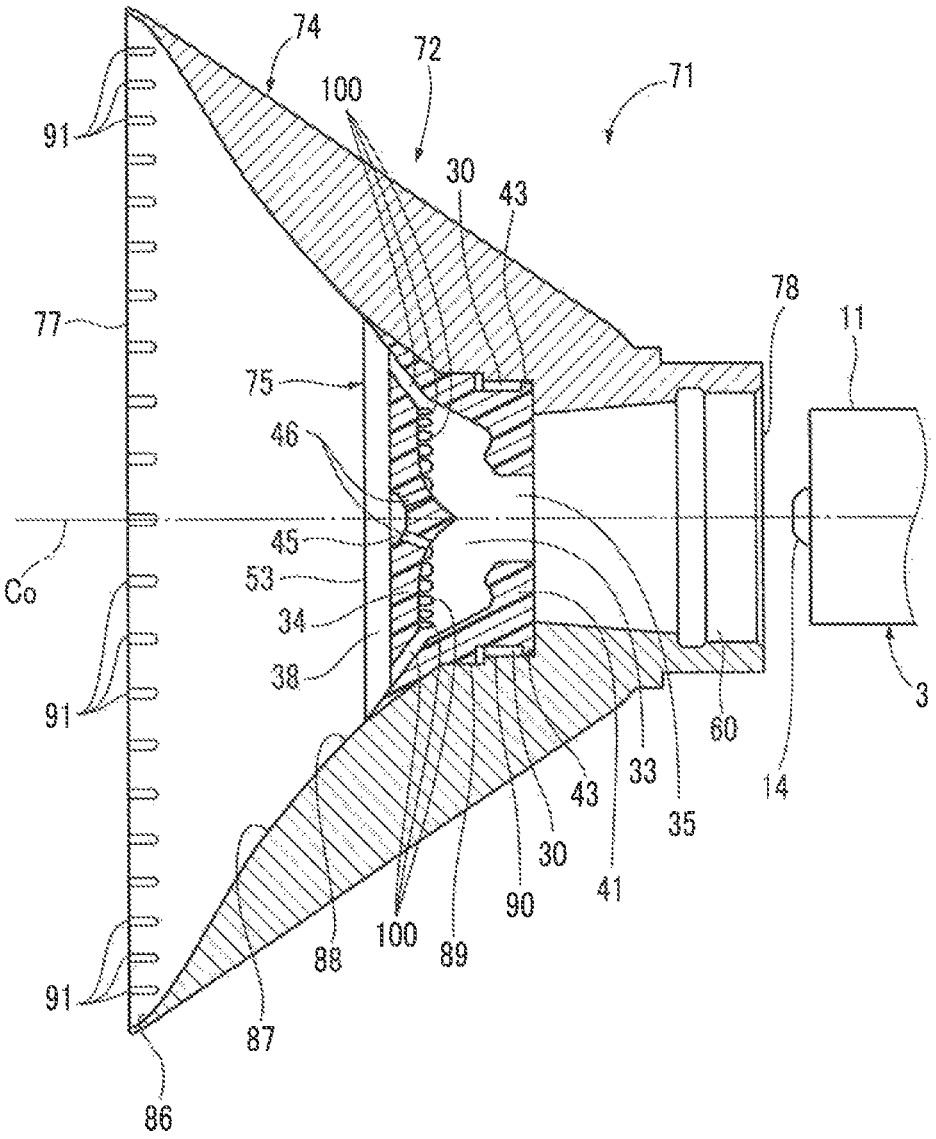
FIG. 3 is a sectional view of a second embodiment of the rotary atomization type painting device of the present invention.
Figure 5:
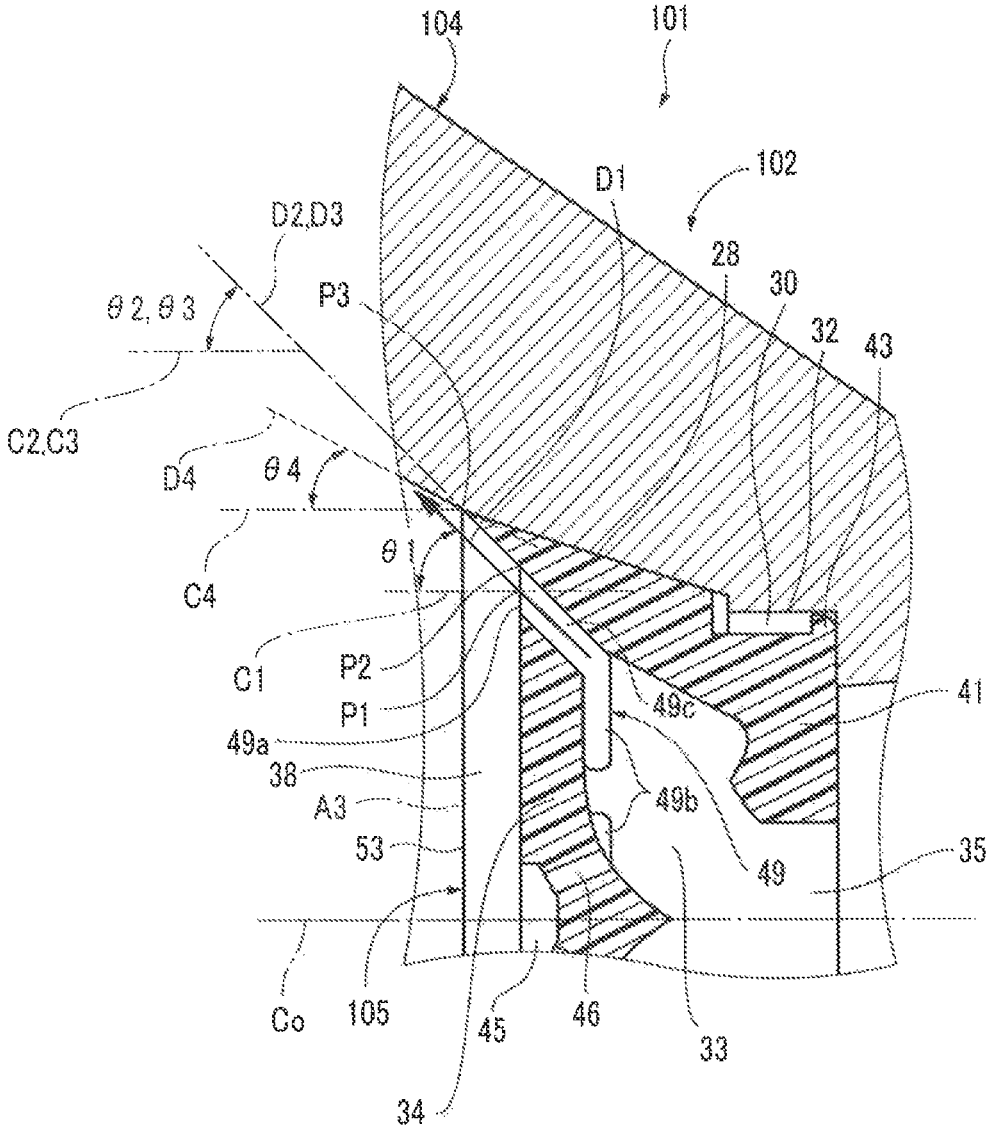
FIG. 5 is a sectional view of a main part of an atomization head according to a modification of the rotary atomization type painting device of the first embodiment.

FIG. 1A is a longitudinal sectional view of a rotary atomization type painting device 1. This rotary atomization type painting device 1, and below described rotary atomization type painting devices 71 (FIG. 3), 101 (FIG. 5) each are used in, for example, a painting process for a vehicle body of a motor vehicle. In the painting of the vehicle body, hard flakes such as metal and a natural stone are sometimes mixed in paint. The rotary atomization type painting devices 1, 101 in FIG. 1A and FIG. 5 are used when paint is atomized in high speed rotation, and the rotary atomization type painting device 71 in FIG. 3 is used when paint is atomized in low speed rotation.

The rotary atomization type painting device 1 of the first embodiment includes an atomization head 2 that injects paint atomized in liquid thread shapes from a large diameter side, and a paint supply machine 3 that engages with a small diameter side of the atomization head 2, and supplies paint to the atomization head 2 while rotating the atomization head 2 around the axis Co.

The paint supply machine 3 has a hollow rotating shaft 11, a paint supply pipe (not illustrated) supported in the rotating shaft 11 so as to be rotatable relative to the rotating shaft 11, and a nozzle part 14 disposed at a leading end of the paint supply pipe. Paint is pressure-fed from a predetermined pump (not illustrated) into the paint supply pipe to be injected from the nozzle part 14.

The atomization head 2 includes an outer member 4 that includes a truncated conical body having both large diameter side and small diameter side ends opened by a large diameter side opening 7 and a small diameter side opening 8, respectively, and an inner member 5 that is detachably disposed inside the outer member 4.

The atomization head 2 atomizes paint from the large diameter side opening 7. The outer member 4 is made of, for example, aluminum, and the inner member 5 is made of, for example, resin. The rotating shaft 11 is connected to the end on the small diameter side of the outer member 4 by screwing or the like.

In FIG. 1A, the axis Co is a center line of the atomization head 2, and the atomization head 2 rotates integrally with the rotating shaft 11 around the axis Co (around the axis) during painting work. The axis Co is also respective center lines of the outer member 4 and the inner member 5. Hereinafter, the "large diameter side" and the "small diameter side" simply mentioned mean the side of the large diameter open end and the side of the small diameter open end in the direction of the axis Co in the atomization head 2 (hereinafter, appropriately referred to as the "axial direction"), respectively.

On an inner surface of the outer member 4, a recessed or concave surface part 26, a projecting or convex surface part 27, a tapered surface part 28, and cylindrical surface parts 31, 32 are formed in an axial range from the large diameter side opening 7 to the end on the small diameter side of the inner member 5 in order from the large diameter side opening 7. The cylindrical surface part 32 has a smaller diameter than the cylindrical surface part 31, and the cylindrical surface part 32 is formed with L-shaped grooves 30 described below.

The recessed surface part 26 and the projecting surface part 27 have respective recessed and projecting curved surfaces that face the axis Co. The tapered surface part 28 is formed so as to gradually reduce an inner diameter toward the small diameter side of the outer member 4.

A plurality of vertical grooves 29 are formed so as to extend at equal angular intervals in the circumferential direction on an end part of the recessed surface part 26 which the end part is near to the large diameter open end of the outer member 4 than the other end part. The depth of each axial position of the vertical grooves 29 is defined so as to increase toward the large diameter side of the outer member 4.

In a cylindrical surface part 32 of the inner surface of the outer member 4, the plurality of L-shaped grooves 30 are formed at equal angle in the circumferential direction. The L-shaped grooves 30 each have a vertical portion in parallel to the axial direction, and a circumferential portion communicated with an end on the small diameter side of the vertical portion, and extending in the direction around the axis Co (hereinafter, referred to as the "circumferential direction").

The inner member 5 has a paint pool part 33 therein. The paint pool part 33 is formed in such a shape as so increase a diameter toward the large diameter side such that paint smoothly moves to the large diameter side by centrifugal force.

The inner member 5 has a large diameter side end wall 34 and a small diameter side end wall 41 that define the paint pool part 33 in the axial direction from the large diameter side and the small diameter side, and an annular protruding part 38 that protrudes from a peripheral part of the outer surface of the large diameter side end wall 34 to the large diameter side so as to gradually thin toward the large diameter side.

An outer surface of the inner member 5 has a portion in contact with the tapered surface part 28 of the outer member 4, the portion being a tapered surface whose inclination angle is the same as the inclination angle of the tapered surface part 28 with respect to the axis Co. The outer surface of the inner member 5 has respective portions in contact with the cylindrical surface parts 31, 32 of the outer member 4, the respective portions being cylindrical surfaces having the same diameters as the cylindrical surface parts 31, 32.

A large diameter side end 53 of the annular protruding part 38 may be sharpened at an acute angle, but is generally formed with a round part in such a range as to maintain a state with no substantially radial level difference from the tapered surface part 28, in order to prevent damage. The large diameter side end 53 is a circumferential line as viewed from the large diameter side opening 7.

An opening 35 is formed at a central part of the small diameter side end wall 41, and the paint pool part 33 is communicated with the small diameter side opening 8.

A circular recess 45 is formed at a central part of the outer surface of the large diameter side end wall 34. A central part of an inner surface of the large diameter side end wall 34 is a raised part that is raised in a conical shape toward the small diameter side. A plurality of through holes 46 are formed in the raised part at a predetermined inclination angle with respect to the axis Co such that center lines of the through holes are concentrated at one point on the large diameter side with respect to the circular recess 45, and communicate the paint pool part 33 with the circular recess 45 at the central part of the large diameter side end wall 34.

A plurality of slit-like lead-out holes 49 are bored in a peripheral part of the large diameter side end wall 34 at equal angular intervals in the circumferential direction, and each have a slit cross-section formed in a long rectangle in the circumferential direction of the inner member 5 (to be exact, two long sides are arcs). The lead-out holes 49 lead out paint in the peripheral part of the paint pool part 33 to a root of an inner surface of the annular protruding part 38.

Figure 1B:
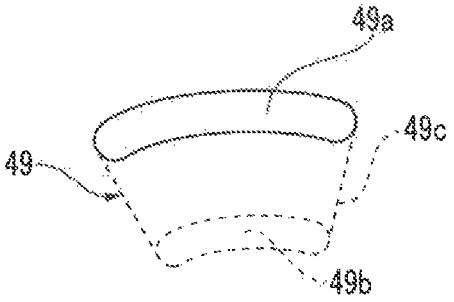

FIG. 1B is an enlarged perspective view of the lead-out hole 49. In FIG. 1A and FIG. 1B, the lead-out holes 49 each have an end 49*a* on the large diameter side, an end 49*b* on the small diameter side, and a communication part 49*c* that communicates the ends 49*a*, 49*b* with each other. The paint flows in the direction from the ends 49*b* to the ends 49*a* (direction of an arrow D1 in FIG. 2) of the lead-out holes 49.

Protrusions 43, the number of which is the same as the number of the above L-shaped grooves 30 of the outer member 4, are formed on the small diameter side end of the outer surface of the inner member 5 in the circumferential direction at equal angular intervals. The protruding amounts of the protrusions 43 are set to be equal to the depths of the above L-shaped grooves 30.

Figure 1C:
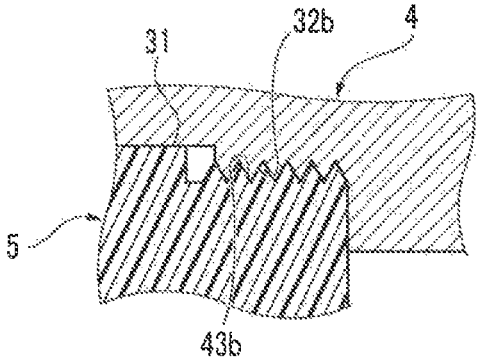

FIG. 1C is a sectional view of a modification of a connecting structure of the L-shaped grooves 30 and the protrusions 43 in FIG. 1A. In FIG. 1A, the inner member 5 is detachably connected to an inner circumference of the outer member 4 by the L-shaped grooves 30 and the protrusions 43. However, a screwing structure can be employed as a modification. In the modification, a female screw 32*b* of an outer member 4, and a male screw 43*b* of an inner member 5 are screwed, so that the outer member 4 and the inner member 5 are connected to each other. The female screw 32*b* is axially formed at a portion of a cylindrical surface part 32 in FIG. 1A.

Figure 2:
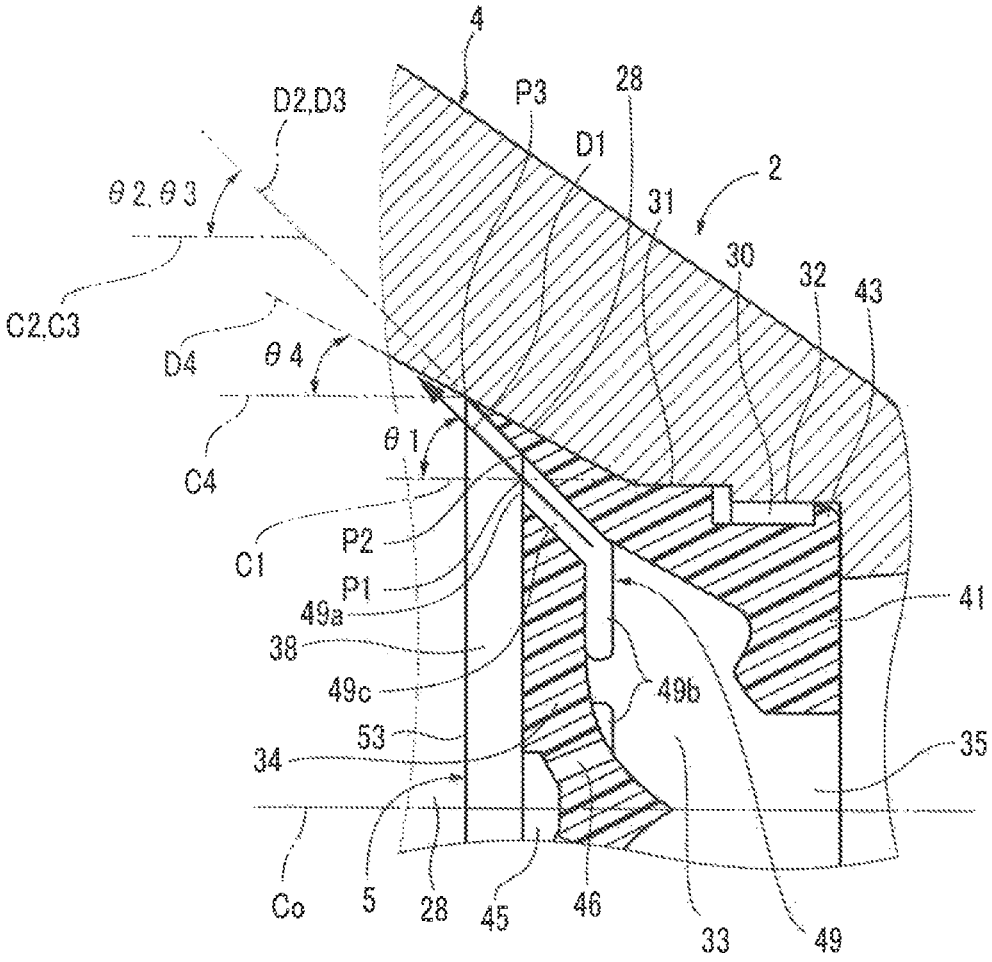
FIG. 2 is an explanatory diagram for inclination angles at predetermined portions of the first embodiment.

FIG. 2 is an explanatory diagram for inclination angles at predetermined portions of the atomization head 2 of the first embodiment.

In FIG. 2, P1 denotes a position of the center of the end 49*a* of each lead-out hole 49. P2 denotes a root position of the inner surface of the annular protruding part 38. P3 denotes a leading end position of the annular protruding part 38 (end position on the large diameter side). The position P1 and the position P2 are located at the axially same position. The position P3 is located on the large diameter side by the length of the annular protruding part 38 with respect to the position P2 in the axial direction.

In FIG. 2, the arrow D1 denotes the paint lead-out direction at the position P. In this embodiment, the lead-out holes 49 each linearly extend in a rectangle cross-section, and therefore the arrow D1 coincides with the center line of each lead-out hole 49. A straight line D2 is a tangential line at the position P2 with respect to a contour line of the inner surface of the annular protruding part 38 on a cut surface when the inner member 5 is cut by a plane including the axis Co and the position P2.

A straight line D3 is a tangential line at the position P3 with respect to a contour line of the inner surface of the annular protruding part 38 on a cut surface when the inner member 5 is cut by a plane including the axis Co and the position P3. In this embodiment, the inner surface of the annular protruding part 38 is formed by a tapered surface, and therefore the straight lines D2, D3 overlap with each other. A straight line D4 is a tangential line at the position P3 with respect to a contour line of the inner surface of the outer member 4 on a cut surface when the outer member 4 is cut by a plane including the axis Co and the position P3.

In FIG. 2, the auxiliary axes C1 to C4 are illustrated for convenience' sake of description of the inclination angles θ1 to θ4, and are straight lines in parallel to the axis Co. θ1 denotes the inclination angle of the arrow D1 with respect to the axis Co, and means the inclination angle in the lead-out direction of each lead-out hole 49 at the position P1. θ2 denotes the inclination angle of the straight line D2 with respect to the axis Co, and means the inclination angle of the inner surface of the annular protruding part 38 at the position P2. θ3 denotes the inclination angle of the straight line D3 with respect to the axis Co, and means the inclination angle of the inner surface of the annular protruding part 38 at the position P3. θ4 denotes the inclination angle of the straight line D4 with respect to the axis Co, and means the inclination angle of the tapered surface part 28 at the position P3 with respect to the axis Co.

The tapered surface part 28, the lead-out holes 49, the inner surface of the annular protruding part 38, and the outer surface of the inner member 5 are formed such that θ1=θ2, and θ3>θ4 are set. In a case where θ3<θ4 are not set, θ3=θ4 may be set. Additionally, the lead-out holes 49 are axially continued to the inner surface of the annular protruding part 38 in a state with no level difference in the radial direction of the atomization head 2 at the position P2.

In this atomization head 2, θ1, θ2, and θ3 are each set to 50°, and θ4 is set to 28°.

Now, action of the above rotary atomization type painting device 1 will be described.

The rotating shaft 11 of the paint supply machine 3 has turbine blades (not illustrated) on an end opposite to the atomization head 2, and the rotating shaft 11 rotates at a predetermined rotational speed by blowing of pressurized air to the turbine blades. Consequently, the atomization head 2 rotates around the axis Co at the same rotational speed as the rotating shaft 11.

The paint supply machine 3 rotates the atomization head 2, and supplies paint from the nozzle part 14 into the paint pool part 33 of the atomization head 2. The paint in the paint pool part 33 receives centrifugal force generated by the rotation of the atomization head 2 to move on the peripheral side inside the paint pool part 33, and is pushed out to be lead out to the inner surface of the annular protruding part 38 through the lead-out holes 49.

The paint lead-out direction from each lead-out hole 49, and the inner surface of the annular protruding part 38 are formed by the relation of θ1=θ2, as described with reference to FIG. 2. Therefore, while the paint led out by the lead-out holes 49 maintains the advancing directions in the lead-out holes 49, and does not deviate from the inner surface of the annular protruding part 38 in the radial direction of the outer member 4, contact with the inner surface of the annular protruding part 38 is maintained, and the paint advances toward the large diameter side end 53 of the annular protruding part 38.

As a result, an impact to the inner surface of the annular protruding part 38 directly after the paint moves out from the lead-out holes 49 to the annular protruding part 38, namely, impact force is relaxed. Additionally, while reduction in the speed of the paint is suppressed, the paint expands on the inner surface of the annular protruding part 38 in the circumferential direction to become a thin film.

Thereafter, the paint moves from the annular protruding part 38 to the tapered surface part 28. That is, after the paint moves out from the lead-out holes 49, the paint suitably becomes a thin film on the inner surface of the annular protruding part 38, and then enters the tapered surface part 28. Furthermore, the annular protruding part 38 is gradually thinned toward the large diameter side end 53, and is axially continued to the tapered surface part 28 in a state with no radial level difference at the large diameter side end 53 (position P3) (however, a slight level difference of a round part of the large diameter side end 53 exists). This means that the impact of the paint to the tapered surface part 28 directly after the paint moves from the annular protruding part 38 to the tapered surface part 28 is relaxed, and the wear of the tapered surface part 28 is suppressed.

On the other hand, as described with reference to FIG. 2, the relation of θ3≥θ4 (although θ3>θ4 is set in FIG. 2, θ3=θ4 may be set) is set. This means that the paint does not deviate from the tapered surface part 28 directly after moving from the annular protruding part 38 to the tapered surface part 28, and the contact state with the tapered surface part 28 is maintained. As a result, the paint suitably diffuses on the tapered surface part 28.

Thereafter, the paint enters the projecting surface part 27 (equivalent to a "first paint diffusion part" in the present invention). The projecting surface part 27 includes the curved surface projecting toward the axis Co, and therefore the paint advancing direction comes close to the direction of the centrifugal force. Consequently, while retention of the paint at a part of the projecting surface part 27 is suppressed, the advancing speed of the paint is increased, and thinning of a film is further facilitated.

Thereafter, the paint enters the recessed surface part 26 (equivalent to a "second paint diffusion part" in the present invention). The recessed surface part 26 includes the curved surface recessed toward the axis Co, and therefore the lengths in the direction of the axis Co of the vertical grooves 29 are secured compared to a case where the recessed surface part 26 is a tapered surface. Thus, the paint is suitably formed in liquid thread shapes by the vertical grooves 29 to be discharged from the atomization head 2.

Now, replacement work of the inner member 5 will be described. With the wear of the inner surface of the annular protruding part 38 of the inner member 5, the inner member 5 needs to be replaced. The replacement of the inner member 5 can be performed, when the color of paint for painting is changed, or also when replacement with new one is performed in place of cleaning work of the inner member 5.

A worker inserts a predetermined engaging tool (not illustrated) into the outer member 4 from the small diameter side opening 8, rotates the inner member 5 with respect to the outer member 4 by a predetermined amount by using the engaging tool, and then pushes the inner member 5 toward the large diameter side opening 7 in the axial direction inside the outer member 4.

Consequently, after the protrusions 43 of the inner member 5 moves in the circumferential portions of the L-shaped grooves 30, the vertical portions of the L-shaped grooves 30 are pushed out toward the large diameter side opening 7 to be pulled out from the L-shaped grooves 30. Thereafter, the inner member 5 is discharged to the outside of the outer member 4 through the large diameter side opening 7.

Then, a new inner member 5 is inserted into the outer member 4 through the large diameter side opening 7, and is pushed in toward the small diameter side opening 8, the protrusions 43 of the inner member 5 move the vertical portions of the L-shaped grooves 30 in the axial direction, and thereafter the circumferential portions of the L-shaped grooves 30 are rotated in the circumferential direction to be brought into a locked state (mounted state) to the outer member 4.

The inner member 5 is made of resin, and has elasticity, and therefore with mounting of the inner member 5 on the inner surface of the outer member 4, the inner member 5 is suitably compressed in the radial direction. Thus, the outer surface of the inner member 5 is held in a state of being closely adhered to the inner surface of the outer member 4 after the mounting of the inner member 5.

FIG. 3 is a longitudinal sectional view of a rotary atomization type painting device 71 of a second embodiment. The rotary atomization type painting device 71 has a structure in which paint can be atomized in low speed rotation, different from the above rotary atomization type painting device 1 of the first embodiment.

The rotary atomization type painting device 71 includes an atomization head 72 and a paint supply machine 3. The paint supply machine 3 of the rotary atomization type painting device 1 and the paint supply machine 3 of the rotary atomization type painting device 71 are the same, and therefore description thereof will be omitted. The atomization head 72 are different from the atomization head 2 only in a part of a structure, and other parts are the same. Structure parts of the atomization head 72 identical with the structure parts of the atomization head 2 are denoted by the same reference numerals assigned to the structure parts of the atomization head 2, and description thereof will be omitted.

The atomization head 72 has an outer member 74, and an inner member 75 that is disposed inside the outer member 74. A basic configuration of the outer member 74 is the same as the basic configuration of the outer member 4 except that the thickness of the outer member 74 is different from the thickness of the outer member 4 of the atomization head 2 of the rotary atomization type painting device 1. The outer member 74 is made of aluminum, and has a large diameter side opening 77 and a small diameter side opening 78 at axial both ends.

An inner surface of the outer member 74 has a recessed surface part 86, a projecting surface part 87, a tapered surface part 88, and cylindrical surface parts 89, 90 in an axial range from the large diameter side opening 77 to the end on the small diameter side of the inner member 75 in order from the large diameter side. The cylindrical surface part 90 has a smaller diameter than the cylindrical surface part 89, and the cylindrical surface part 90 is formed with L-shaped grooves 30. As a connecting structure in which the outer member 74 and the inner member 75 are detachably attached to each other, the screwing structure illustrated in FIG. 1C can be also employed in place of the connecting structure by the L-shaped grooves 30 and protrusions 43.

Respective recessed and projecting curved surfaces of the recessed surface part 86 and the projecting surface part 87 face in a range from the side of the axis Co to the large diameter side. The tapered surface part 88 is formed so as to gradually reduce an inner diameter toward a position on the small diameter side of the atomization head 72 in the axial direction.

The axial length of the projecting surface part 87 is increased compared to the axial length of the projecting surface part 27 of the rotary atomization type painting device 1. Therefore, the axial length of the tapered surface part 88 is shorter than the axial length of the tapered surface part 28 of the rotary atomization type painting device 1 by the increased amount, and the thickness of the outer member 74 is also different from the thickness of the outer member 4 (FIG. 1A). Vertical grooves 91 are formed on the recessed surface part 86 so as to have the same shapes and the same sizes as the vertical grooves 29 of the rotary atomization type painting device 1.

The inner member 75 is made of resin, and has the same configuration of the inner member 5 of the atomization head 2 of the rotary atomization type painting device 1 except lead-out holes 100.

The plurality of lead-out holes 100 include through holes having circular cross-sections, and are bored in a peripheral part of a large diameter side end wall 34 at equal angular intervals in the circumferential direction. The lead-out holes 100 extend linearly, lead out paint in a peripheral part of a paint pool part 33 to a small diameter side end of the tapered surface part 88.

Figure 4:
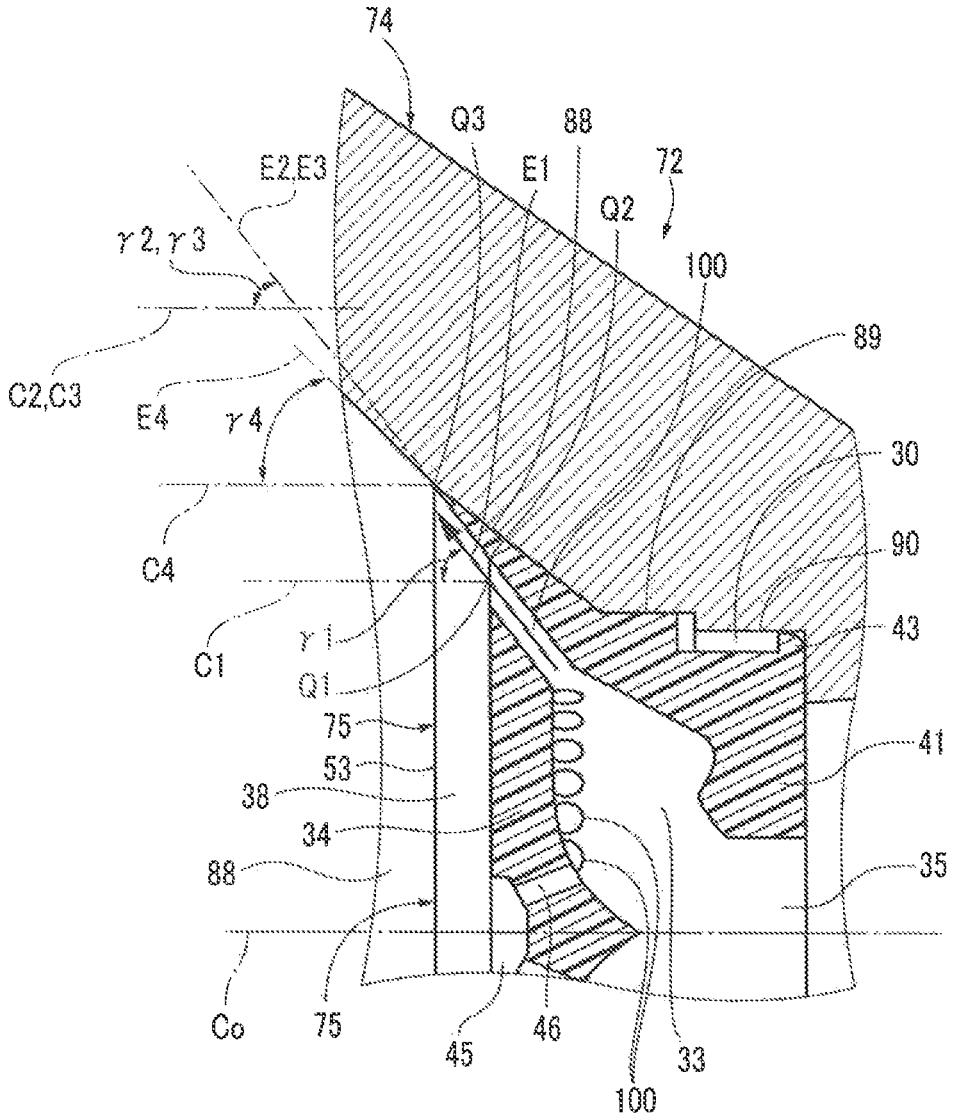
FIG. 4 is an explanatory diagram for inclination angles at predetermined portions of the second embodiment.

FIG. 4 is an explanatory diagram for inclination angles at predetermined portions of the atomization head 72 of the second embodiment.

Positions Q1 to Q3, an arrow E1, and straight lines E2 to E4 in FIG. 4 correspond to the positions P1 to P3, the arrow D1, and the straight line D2 to D4 in FIG. 2. Q1 denotes a position of the center of a large diameter side end of each lead-out hole 100. Q2 denotes a root position (end position on the small diameter side) of an annular protruding part 38. Q3 denotes a leading end position of the annular protruding part 38 (position on a large diameter side end 53). The position Q1 and the position Q2 are located at the axially same position. The position Q3 is located on the large diameter side by an amount equivalent to the protruding length of the annular protruding part 38 with respect to the position Q2 in the axial direction.

In FIG. 4, the arrow E1 denotes the paint lead-out direction at the position Q1. In this embodiment, the lead-out holes 100 each linearly extend in a circular cross-section, and therefore the arrow E1 coincides with the center line of each lead-out hole 100. The straight line E2 is a tangential line at the position Q2 with respect to a contour line of an inner surface of the annular protruding part 38 on a cut surface when the inner member 75 is cut by a plane including the axis Co and the position Q2.

The straight line E3 is a tangential line at the position Q3 with respect to a contour line of the inner surface of the annular protruding part 38 on a cut surface when the inner member 75 is cut by a plane including the axis Co and the position Q3. In this embodiment, the inner surface of the annular protruding part 38 is formed by a tapered surface, and therefore the straight lines E2, E3 overlap with each other. The straight line E4 is a tangential line at the position Q3 with respect to a contour line of an inner surface of the outer member 74 on a cut surface when the outer member 74 is cut by a plane including the axis Co and the position Q3.

In FIG. 4, the auxiliary axes C1 to C4 are defined in the same manner as those in FIG. 2. $\gamma 1$ denotes the inclination angle of the arrow E1 with respect to the axis Co, and means the inclination angle in the lead-out direction of each lead-out hole 100 at the position Q1. $\gamma 2$ denotes the inclination angle of the straight line E2 with respect to the axis Co, and means the inclination angle of the inner surface of the annular protruding part 38 at the position Q2. $\gamma 3$ denotes the inclination angle of the straight line E3 with respect to the axis Co, and means the inclination angle of the inner surface of the annular protruding part 38 at the position Q3. $\gamma 4$ denotes the inclination angle of the straight line E4, and means the inclination angle of the tapered surface part 88 with respect to the axis Co at the position Q3.

The tapered surface part 88, the lead-out holes 100, and the annular protruding part 38 are formed such that $\gamma 1=\gamma 2$, and $\gamma 3>\gamma 4$ are set. In a case where $\gamma 3<\gamma 4$ are not set, $\gamma 3=\gamma 4$ may be set. Additionally, the lead-out holes 100 are axially continued to the inner surface of the annular protruding part 38 in a state with no level difference in the radial direction at the position Q2.

In this atomization head 72, $\gamma 1$, $\gamma 2$, and $\gamma 3$ are each set to 50°, and $\gamma 4$ is set to 35°.

Action of the rotary atomization type painting device 71 will be described. Description of parts overlapped with the action of the rotary atomization type painting device 1 will be omitted, and only differences from the action of the rotary atomization type painting device 1, and main points will be described.

The paint in the paint pool part 33 receives centrifugal force generated by the rotation of the atomization head 72 to move on the peripheral side inside the paint pool part 33, and is lead out to the inner surface of the annular protruding part 38 through the lead-out holes 100.

The paint lead-out direction from each lead-out hole 100, and the inner surface of the annular protruding part 38 are formed by the relation of $\gamma 1=\gamma 2$, as described with reference to FIG. 4. Therefore, while the paint led out by the lead-out holes 100 maintains the advancing directions, and does not deviate from the inner surface of the annular protruding part 38 in the radial direction of the outer member 74, contact with the inner surface of the annular protruding part 38 is maintained, and the paint advances toward the large diameter side end 53 of the annular protruding part 38.

As a result, an impact to the inner surface of the annular protruding part 38 when the paint moves out from the lead-out holes 100 to the annular protruding part 38, namely, impact force is relaxed. Additionally, while reduction in the speed of the paint is suppressed, the paint expands on the inner surface of the annular protruding part 38 in the circumferential direction to become a thin film.

Thereafter, the paint moves from the annular protruding part 38 to the tapered surface part 88. That is, after the paint moves out from the lead-out holes 100, the paint suitably becomes a thin film on the annular protruding part 38, and then enters the tapered surface part 88. Furthermore, the annular protruding part 38 is gradually thinned toward the large diameter side end 53, and is axially continued to the tapered surface part 88 in a state with no radial level difference at the large diameter side end 53 (however, a slight level difference of a round part of the large diameter side end 53 exists). This means that the impact of the paint to the tapered surface part 88 directly after the paint moves from the annular protruding part 38 to the tapered surface part 88 is relaxed, and the wear of the tapered surface part 88 is suppressed.

On the other hand, as described with reference to FIG. 4, the relation of $\gamma 3\geq\gamma 4$ (although $\gamma 3>\gamma 4$ is set in FIG. 4, $\gamma 3=\gamma 4$ may be set) is set. This means that when the paint moves from the annular protruding part 38 to the tapered surface part 88, the paint does not deviate from the tapered surface part 88, and the contact state with the tapered surface part 88 is maintained. As a result, the paint suitably diffuses on the tapered surface part 88.

Thereafter, the paint enters the projecting surface part 87. The projecting surface part 87 includes the curved surface projecting toward the axis Co, and therefore the paint advancing direction comes close to the direction of the centrifugal force. Consequently, while retention of the paint at a part of the projecting surface part 87 is suppressed, the advancing speed of the paint is increased, and thinning of a film is further facilitated.

Thereafter, the paint enters the recessed surface part 86. The recessed surface part 86 includes the curved surface recessed toward the axis Co, and therefore the lengths in the direction of the axis Co of the vertical grooves 91 are secured compared to a case where the recessed surface part 86 is a tapered surface. Thus, the paint is suitably formed in liquid thread shapes by the vertical grooves 91 to be discharged from the atomization head 72.

Replacement work of the inner member 75 is the same as the replacement work of the inner member 5 of the rotary atomization type painting device 1, and therefore description thereof will be omitted.

FIG. 5 is a sectional view of a main part of an atomization head 102 according to the rotary atomization type painting device 101 as a modification of the rotary atomization type painting device 1 in FIG. 1A. The rotary atomization type painting device 101 includes a paint supply machine 3 (FIG. 1A), and the atomization head 102 replaced by the atomization head 2 (FIG. 1A and FIG. 2). Structure parts of the atomization head 102 identical with the structure parts of the atomization head 2 are denoted by the same reference numerals assigned to the structure parts of the atomization head 2, and description thereof will be omitted.

The atomization head 2 in FIG. 1A and FIG. 2 and the atomization head 102 in FIG. 5 are different only in surface shapes of mounting portions of an outer member and an inner member, and other structures are the same. That is, in the atomization head 2, the cylindrical surface part 31 having the large diameter exists between the tapered surface part 28 and the cylindrical surface part 32 having the small diameter in the axial direction on the inner surface of the outer member 4. On the other hand, in the atomization head 102, a cylindrical surface part 31 having a large diameter does not exists on an inner surface of the outer member 104, a tapered surface part 28 and a cylindrical surface part 32 having a small diameter are directly continued to each other in the axial direction.

An outer surface of the inner member 105 is a shape surface corresponding to the inner surface of the outer member 104 in the mounting portion. More specifically, a cylindrical surface part corresponding to the cylindrical surface part 31 of the outer member 104 in FIG. 1A and FIG. 2 does not exist on the outer surface of the inner member 105. In other words, the outer surface of the inner member 105 has a tapered surface part corresponding to the tapered surface part 28 of the outer member 4, and a cylindrical surface part corresponding to the cylindrical surface part 32.

Thus, in the rotary atomization type painting devices 1, 71, 101, in the inner members 5, 75, 105, the annular protruding parts 38 that are thinned toward the large diameter side ends 53 are formed in peripheral parts of the large diameter side ends 53, and the large diameter side ends 53 of the annular protruding parts 38 are continued to the tapered surface parts 28, 88 of the outer members 4, 74, 104 in the axial direction in a state with no radial level difference. Furthermore, the inclination angles θ1, γ1 in the lead-out directions of the lead-out holes 49, 100 with respect to the axes Co, and the inclination angles θ2, γ2 of the inner surfaces of the annular protruding parts 38 are equally set to the positions P1, Q1 of the ends on the large diameter sides of the lead-out holes 49, 100 in the axial direction.

Consequently, it is possible to weaken impact force of paint to the inner surfaces of the atomization heads 2, 72, 102, and extend the life of the rotary atomization type painting devices 1, 71, and the atomization heads 2, 72, 102.

As described above, the illustrated embodiments are described. However, the present invention is not limited to the embodiments.

For example, the lead-out holes 49, 100 have slit-like cross-sections and circular cross-sections, respectively in the above embodiment, but are not limited to theses. For example, the lead-out holes may have elliptical cross-sections.

In the above embodiment, the tapered surface parts 28, 88 are formed in the outer members 4, 74, 104. However, the tapered surface parts 28, 88 can be omitted.

In the above embodiment, coating films for wear prevention against paint are not coated on the inner surfaces of the outer members 4, 74, 104. However, the coating films are suitably formed, and wear resistance can be further strengthened.

The atomization head 102 in FIG. 5 has a structure in which the cylindrical surface part 31 of the outer member 4, and the cylindrical surface part of the inner member 5 corresponding to the cylindrical surface part 31 are omitted from the atomization head 2 in FIG. 1A. Similarly, a structure in which the cylindrical surface part 89 of the outer member 74, and the cylindrical surface part of the inner member 75 corresponding to the cylindrical surface part 89 are omitted from the atomization head 72 in FIG. 3 can be employed in the atomization head 72.

REFERENCE SIGNS LIST

1, 71, 101 . . . rotary atomization type painting device
2, 72, 102 . . . atomization head
3 . . . paint supply machine
4, 74, 104 . . . outer member
5, 75, 105 . . . inner member
7, 77 . . . large diameter side opening
8, 87 . . . small diameter side opening
26, 86 . . . recessed surface part (second paint diffusion part)
27, 87 . . . projecting surface part (first paint diffusion part)
29, 91 . . . vertical groove
38 . . . annular protruding part
49, 100 . . . lead-out hole
53 . . . large diameter side end

The invention claimed is:

1. A rotary atomization type painting device comprising:

an atomization head having an outer member that includes a truncated conical body having both a large diameter open end on a large diameter side and a small diameter open end on a small diameter side, an inner member that is disposed inside the outer member, and a plurality of lead-out holes that are formed in a peripheral part of the inner member, the atomization head being configured to lead out paint supplied from the small diameter open end of the outer member to the inner member, toward the large diameter open end of the outer member through the lead-out holes, and atomize the paint from the large diameter open end; and a paint supply machine that engages with the small diameter open end, and supplies the paint to the inner member while rotating the atomization head around an axis, the axis being a center line of the truncated conical body of the outer member of the atomization head extending in an axial direction between the large diameter open end and the small diameter open end, wherein the inner member has an annular protruding part that protrudes so as to gradually thin toward the large diameter open end, and is formed such that an outer surface of the inner member is closely adhered to an inner surface of the outer member, the lead-out holes and the annular protruding part are formed such that an angle in a lead-out direction of each of the lead-out holes with respect to the axis, and an angle of an inner surface of the annular protruding part with respect to the axis are equal at a position of an end on a side of the large diameter open end of the lead-out hole in the axial direction, at a position of an end on a side of the large diameter open end of the annular protruding part in the axial direction, an inclination angle of the inner surface of the annular protruding part with respect to the axis is set to greater than an inclination angle of the inner surface of the outer member with respect to the axis at a corresponding position in the axial direction, and the inner surface of the outer member continuously increases in diameter from said corresponding position in the axial direction to the large diameter open end of the outer member, said corresponding position overlapping with the position of the end on the side of the large diameter open end of the annular protruding part in the axial direction.

2. The rotary atomization type painting device according to claim 1, wherein the inner member is detachably attached to the outer member.

3. The rotary atomization type painting device according to claim 1, wherein the outer member has, on an inner surface on a side close to the large diameter open end with respect to the annular protruding part, a first paint diffusion part formed as a convex surface toward the axis of the cylindrical body, and a second paint diffusion part formed as a concave surface toward the axis of the cylindrical body extending from the first paint diffusion part to an outer edge of the large diameter open end, and the second paint diffusion part has a plurality of grooves provided on the outer edge.

4. An atomization head comprising:

an outer member that includes a truncated conical body having both a large diameter open end on a large diameter side and a small diameter open end on a small diameter side;

an inner member that is disposed inside the outer member; and a plurality of lead-out holes that are formed in a peripheral part of the inner member, the atomization head being configured to lead out paint supplied from the small diameter open end of the outer member to the inner member, toward the large diameter open end of the outer member through the lead-out holes, and atomize the paint from the large diameter open end, wherein an axis of the atomization head is a center line of the truncated conical body of the outer member extending in an axial direction between the large diameter open end and the small diameter open end, the inner member has an annular protruding part that protrudes so as to gradually thin toward the large diameter open end, and is formed such that an outer surface of the inner member is closely adhered to an inner surface of the outer member, the lead-out holes and the annular protruding part are formed such that an angle in a lead-out direction of each of the lead-out holes with respect to the axis, and an angle of an inner surface of the annular protruding part with respect to the axis are equal at a position of an end on a side of the large diameter open end of the lead-out hole in the axial direction, at a position of an end on a side of the large diameter open end of the annular protruding part in the axial direction, an inclination angle of the inner surface of the annular protruding part with respect to the axis is set to greater than an inclination angle of the inner surface of the outer member with respect to the axis at a corresponding position in the axial direction, and the inner surface of the outer member continuously increases in diameter from said corresponding position in the axial direction to the large diameter open end of the outer member, said corresponding position overlapping with the position of the end on the side of the large diameter open end of the annular protruding part in the axial direction.

* * * * *